United States Patent [19]

Zitelli et al.

[11] 4,204,258

[45] May 20, 1980

[54] TURBINE ACCELERATION GOVERNING SYSTEM

[75] Inventors: William E. Zitelli, Monroeville; Alan T. Heltsley, Chester Upland, both of Pa.

[73] Assignee: Westinghouse Electric Corp., Pittsburgh, Pa.

[21] Appl. No.: 948,263

[22] Filed: Oct. 3, 1978

[51] Int. Cl.[2] ..... F01B 25/06; F01K 13/02

[52] U.S. Cl. ..... 364/494; 60/646; 290/40 A; 415/17; 364/101

[58] Field of Search ..... 364/494, 101, 107, 110, 364/300, 565; 60/645, 660, 646; 290/40 R, 40 A, 40 B, 40 C; 415/15, 16, 17

[56] References Cited

U.S. PATENT DOCUMENTS

| | | | |
|---|---|---|---|
| 3,552,872 | 1/1971 | Giras et al. | 415/17 |
| 3,564,273 | 2/1971 | Cockrell | 415/17 X |
| 4,010,605 | 3/1977 | Uram | 364/494 |
| 4,016,723 | 4/1977 | Farley | 364/565 X |
| 4,029,951 | 6/1977 | Berry et al. | 364/494 |

*Primary Examiner*—Joseph F. Ruggiero
*Attorney, Agent, or Firm*—W. E. Zitelli

[57] ABSTRACT

A turbine speed control system comprising a pair of concurrently operable electronic microprocessor-based controllers which are coupled together by a data link to functionally cooperate in controlling turbine acceleration primarily during start-up operations in accordance with a set of predetermined measured and calculated turbine conditions. One controller is operative to control the speed of the turbine at selected accelerations from turning gear to a predetermined speed value. This same controller monitors a plurality of temperature differences from preselected regions of the turbine and inhibits turbine acceleration in accordance with an out-of-limit temperature condition associated therewith. In addition, the one controller is further operative to selectively override the turbine speed hold initiated by an out-of-limit temperature condition, the override permitting the one controller to proceed with controlling the speed of the turbine at a desired acceleration. The other controller is selectively operative to govern the turbine acceleration as controlled by the one controller based on calculated present and anticipated rotor stresses which are derived concurrently with the speed control operations of the one controller.

9 Claims, 11 Drawing Figures

TURBINE ACCELERATION GOVERNING SYSTEM

BACKGROUND OF THE INVENTION

The present invention relates to steam turbine speed control systems in general, and more particularly to a pair of concurrently operable electronic controllers which are coupled together to functionally cooperate in controlling the turbine acceleration primarily during turbine start-up operations in accordance with calculated present and anticipated rotor stresses, monitored differential temperatures from predetermined regions of the steam turbine, a number of predetermined critical speed zones and a predetermined heat soak speed.

It is well known that there are an increasing number of older steam turbine power plants which are being utilized in cyclic duty operation for stabilizing immediate power demand requirements of power system grids. In this capacity, the steam turbine may be repeatedly cycled between turning gear and synchronization speed, at times, frequently during normal daily power plant operation. A majority of these older steam turbine power plants do not have the benefit of a modern, sophisticated automatic turbine control system to enhance the prevention of deleterious conditions from occurring as a result of these frequent start-up and loading operations. Rather, most of the start-up procedures for these older power plants rely heavily on operator experience and awareness. For this reason, there has been an increase in interest in modernizing the speed control systems of certain types of older steam turbine plants, especially those utilized for cyclic duty.

In most cases, modernization of the turbine speed control systems does not entail merely replacing the older system with one of the sophisticated automatic turbine control system models because of the problems which are presented as a result of this replacement. An example of these problems include interfacing the new control system to the older turbine model for which it was not designed, training the plant operators to effectively and efficiently operate the new control system which generally include advanced control strategies usually incorporating digital computer control techniques, and absorbing the costs associated with parts, installations and testing thereof. Evidently, modernization cannot be handled this simply. Rather, a more acceptable retrofit approach, one which is more likely to satisfy most utilities, may be to offer a replacement which is more specifically designed to interface with their older steam turbine system and which provides more automatic and supervisory features to assist their power plant operators in more cautiously accelerating the turbine speed during the frequent start-up operations normally associated with turbine cyclic duty performance. Such a system is disclosed in the specification to follow.

SUMMARY OF THE INVENTION

A turbine speed control system comprising a pair of concurrently operable electronic controllers which are coupled together to functionally cooperate in controlling the acceleration of turbine speed primarily during start-up operations in accordance with calculated present and anticipated rotor stresses, monitored differential temperatures from predetermined regions of the turbine, a number of predetermined critical speed zones and a preset heat soak speed is disclosed. More specifically, one controller is operative to control the speed of the turbine at selected accelerations from turning gear to a predetermined turbine speed value, and the other controller is selectively operative to govern the turbine acceleration as controlled by the one controller in accordance with calculated present and anticipated rotor stresses, the calculations of which are performed by the other controller concurrently with the speed control operations of the one controller. Additionally included in the system is a means for generating a plurality of signals which are representative of actual temperature differences of predetermined portions of the turbine, the plurality of signals being provided to the one controller. Upon detection of at least one of the representative temperature difference signals exceeding a preset limit value respectively associated therewith, the one controller is further operative to reduce the turbine acceleration to substantially zero. Furthermore, if it is detected that the turbine speed is controllably held substantially fixed in one of a number of critical speed zones as a result of the acceleration governing of the other controller or as a result of a temperature difference signal exceeding its preset limit value, the one controller is still further operative to adjust the turbine speed outside of the one critical speed zone.

In another aspect, the other controller is additionally operative to govern the one controller to reduce the acceleration of the turbine to substantially zero for a predetermined time interval during the turbine start-up operation initiated by the occurrence of at least one of a plurality of conditions including a conditionally selective heat soak actuation and an event in which the turbine speed is controlled substantially to a predetermined heat soak speed value.

In still another aspect, the one controller is additionally operative to selectively override the reduction of the turbine acceleration to substantially zero as caused by at least one representative temperature difference signal exceeding its preset limit value, the override selection rendering control of the turbine speed to proceed at the desired accelerations.

Preferably, both controllers are embodied by microprocessor-based digital hardware, each controller including an interface to provide a data link for signal communication between the two controllers, the data link comprising the turbine acceleration governing signals.

DESCRIPTION OF THE PREFERRED EMBODIMENT

Figure 1:
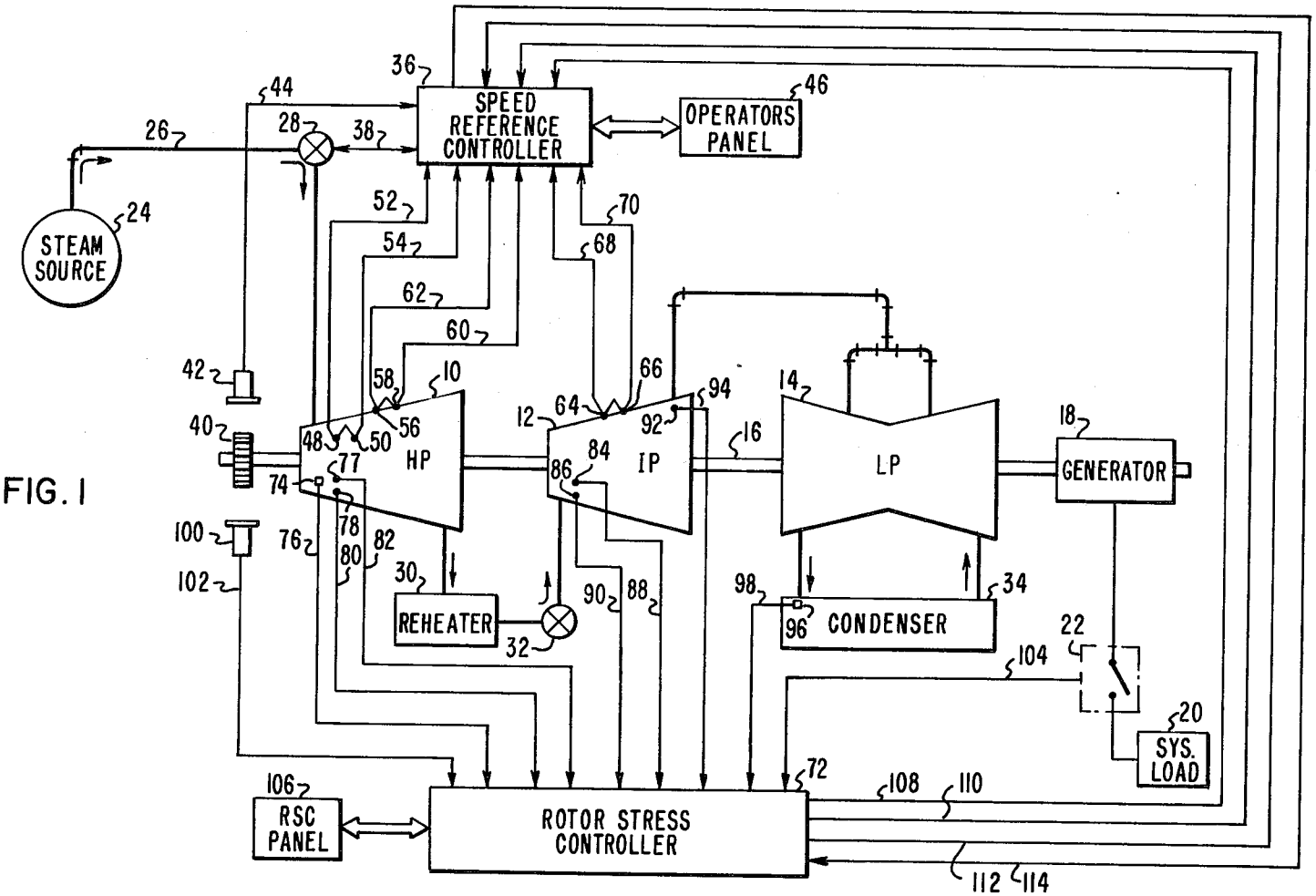
FIG. 1 is a simplified schematic of a steam turbine power plant suitable for embodying the principles of the present invention.

A typical configuration for a turbine generator power plant suitable for embodying the present invention is depcited in FIG. 1. A conventional steam turbine is shown as having a high pressure section 10, an intermediate pressure section 12 and at least one low pressure section 14, all mechanically coupled to a common shaft 16 which drives a generator 18 to convert the mechanical power produced by the steam turbine into electrical power. The electrical power may be supplied to a system load 20 at times when a main breaker 22 is closed. Steam generated from a conventional steam source 24 which may be a fossile fired boiler, for example, is provided to the input of the high pressure turbine section 10 over piping 26. Disposed in the piping 26 between the steam source 24 and the high pressure turbine section 10 is one or more steam admission valves 28. These steam admission valves 28 regulate the steam flow through the steam turbine according to their controlled position opening.

Steam passing through the high pressure turbine section 10 is normally reheated in a reheater section 30 prior to being conducted through the intermediate pressure turbine section 12. Normally, an interceptor valve arrangement 32 is disposed between the reheater and intermediate pressure turbine section 12 for purposes of regulating the steam flow therebetween. Steam flow exiting the intermediate pressure turbine section 12 is primarily conducted to the one or more lower pressure turbine sections 14. Steam is then exhausted from the lower pressure turbines 14 into a condenser unit 34 within which it may be converted to its water state and resupplied to the steam source 24 through well known methods.

In the present embodiment, a speed reference controller 36 is disposed within the power plant to regulate the steam flowing through the steam turbine by positioning the one or more steam admission valves 28 using the control lines 38. Speed of the steam turbine generator is typically measured by monitoring the rotation of a notched wheel 40 which is mechanically coupled to the steam turbine shaft 16. A well known electromagnetic pickup 42 is disposed adjacent the periphery of the notched wheel and is operative to generate pulses related to the passage of the notches of the wheel 40 by the electromagnetic pickup 42. The generated electrical pulses are conducted to the speed reference controller over signal line 44. The frequency of these pulses is representative of the rotating speed of the steam turbine.

Typically, during a turbine startup operation, a desired speed demand may be entered into the speed reference controller 36 utilizing an operator's panel 46. Thereafter, an acceleration is selected to define the rate at which the speed reference which governs the speed of the steam turbine is ramped towards the desired speed demand. In most cases, the speed reference controller 36 maintains the speed error computed between the speed reference signal generated by the speed reference controller and the speed measurement signal derived from the electrical pulses of signal line 44 close to zero. This is accomplished by positioning the steam admission valve 28 to regulate the steam conducted through the steam turbine.

In accordance with one aspect of the present invention, a plurality of temperature differences relating to predetermined portions of the steam turbine are monitored by the speed reference controller 36. In one example, temperature differences are measured in the first stage of the high pressure turbine section between the inlet steam and inlet metal regions utilizing conventional thermocouples 48 and 50, respectively. The thermocouples 48 and 50 are coupled together such that their generated thermionic voltages provide a differential temperature measurment over signal lines 52 and 54 which are provided to the speed reference controller 36. Another of the differential temperature measurements may be derived from the horizontal flange and horizontal bolt regions of the high pressure turbine section 10, utilizing thermocouples 56 and 58, respectively. Likewise, these thermocouples 56 and 58 are coupled to provide a differential thermionic voltage to the speed reference controller 36 over signal lines 60 and 62. Still another differential temperature may be monitored from the horizontal flange and horizontal bolt regions of the intermediate pressure turbine 12 utilizing thermocouples 64 and 66, which are similarly coupled to provide a differential thermionic voltage to the speed reference controller 36 over signal lines 68 and 70.

In an alternate embodiment, not shown in FIG. 1, such as in the case where an intermediate pressure turbine section is not required as part of the total steam turbine system, a differential temperature measurement may be monitored from the horizontal bolt and horizontal flange inner regions of the high pressure turbine section 10, using similar thermocouple arrangements, and an additional differential temperature may be monitored from the horizontal bolt and horizontal flange center region of the high pressure turbine section 10. Both alternate differential temperature monitorings may be embodied with similar thermocouple configurations to provide the differential thermionic temperature measurements required. All of the differential temperature signals which are provided to the speed reference controller 36 are used to govern the acceleration of the steam turbine system, as will be described in greater detail hereinbelow.

Additionally disposed within the turbine generator power plant is a rotor stress controller 72. A preselected number of turbine variables normally associated with a rotor stress computation are supplied from the high pressure turbine section 10 and intermediate pressure turbine section 12 to the rotor stress controller 72. In one example, the number of preselected turbine variables may comprise a first stage pressure of the high pressure turbine section 10 which may be monitored by a conventional pressure transducer 74 disposed within the first stage region of the high pressure section 10, the transducer 74 providing a pressure signal 76 to the rotor stress controller 72; a first stage metal temperature and a first stage steam temperature which may be monitored by conventional thermocouples 77 and 78, respectively, which are located in the first stage region of the high pressure turbine section 10, the thermocouples 78 and 77 providing temperature signals to the rotor stress controller 72 over signal lines 80 and 82; an inlet steam temperature and a blade ring temperature which may be monitored by thermocouples 84 and 86, respectively, disposed within the inlet region of the intermediate pressure turbine section 12, the thermocouples 84 and 86 providing temperature signals over signal lines 88 and 90, respectively, to the rotor stress controller 72; a steam exhaust temperature which may be monitored by another thermocouple 92 disposed in the steam exhaust region of the intermediate pressure turbine section 12, the thermocouple 92 providing a temperature signal over signal line 94 to the rotor stress controller 72; and a condenser pressure monitored by a conventional pressure transducer 96 disposed within the condenser region of the steam turbine power plant, the transducer 96 providing a pressure signal 98 to the rotor stress controller 72. In addition to the aforementioned temperature and pressure turbine variables supplied to the rotor stress controller 72 a signal representative of turbine speed is additionally monitored by disposing a second electromagnetic pickup 100 in close proximity to the notched wheel 40 so that it may also supply electrical pulses representative of the speed of the steam turbine to the rotor stress controller 72 over signal line 102. Even further, the status of the main breaker 22 may be monitored and a signal representative of that status may be supplied to the rotor stress controller 72 over signal line 104.

The rotor stress controller 72 performs rotor stress calculations using the speed, temperature and pressure variables monitored from the steam turbine system to determine the present stress and anticipated stress at various points on the rotor shaft 16. These rotor stress computations are generally well known and have been described in U.S. Pat. No. 3,588,265 which was issued to William R. Berry on June 28, 1971 and U.S. Pat. No. 4,029,951 issued to William R. Berry et al on June 14, 1977, both patents being presently assigned to the assignee of the instant application. The rotor stress computations described in connection with the aforementioned patents relate to calculating rotor stresses along the rotor shaft at two points, one being located at the inlet of the high pressure turbine section 10 and the other being at the inlet of the intermediate pressure turbine section 12. A rotor model directed to the phenomenon of radial heat transfer conduction through the turbine rotor shaft to the bore region is generally used and may comprise the partitioning the turbine rotor cross-sections into segmented annular regions to calculate the dynamically changing radial temperature distribution through the cross-section of the rotor in accordance with the measured temperature, pressure and speed variables from the turbine system. The specific details of the rotor stress calculations in no way form any part of the present invention.

Once computing the present and anticipated rotor stresses for the various points of the turbine rotor shaft, the rotor stress controller continues to derive therefrom an allowable acceleration limit value. These rotor stress computations and allowable acceleration limit value derivations are continuously performed by the rotor stress controller 72 concurrently with the speed control operations of the speed reference controller 36. A rotor stress controller panel 106 is additionally disposed within the power plant and coupled to the rotor stress controller 72 to provide commands to the rotor stress controller 72 through utilization of pushbuttons and to display numerically certain calculated variables associated with the rotor stress controller 72 and certain status conditions related to both the steam turbine system and the rotor stress controller 72.

The rotor stress controller 72 is additionally selectively operative to govern the steam turbine acceleration as controlled by the speed reference controller 36. A plurality of signal lines comprising, for example, the signal lines 108, 110 and 112, are provided to the speed reference controller 36 from the rotor stress controller 72 for the purposes of governing the turbine acceleration control affected by the speed reference controller 36. In addition to performing rotor stress computations, the rotor stress controller 72 is also selectively operative to govern the speed reference controller 36 to hold the turbine speed substantially fixed for a predetermined time during the turbine startup operation. This predetermined time is normally referred to as heat soaking the turbine. The rotor stress controller 72 may be selected to perform a heat soaking operation from a selective actuation, such as the depression of a pushbutton located on the panel 106, or it may be automatically actuated as a result of the measured speed of the steam turbine being substantially equated to some predetermined heat soak speed. In order for this heat soak period to be actuated, the speed reference should be equated substantially to the speed demand signal. An indication of this condition may be provided from the speed controller 36 to the rotor stress controller 72 over signal line 114. The following descriptions in connection with FIGS. 2 and 3 herebelow will provide a more detailed understanding of the operation of both the speed reference controller 36 and rotor stress controller 72.

Figure 2:
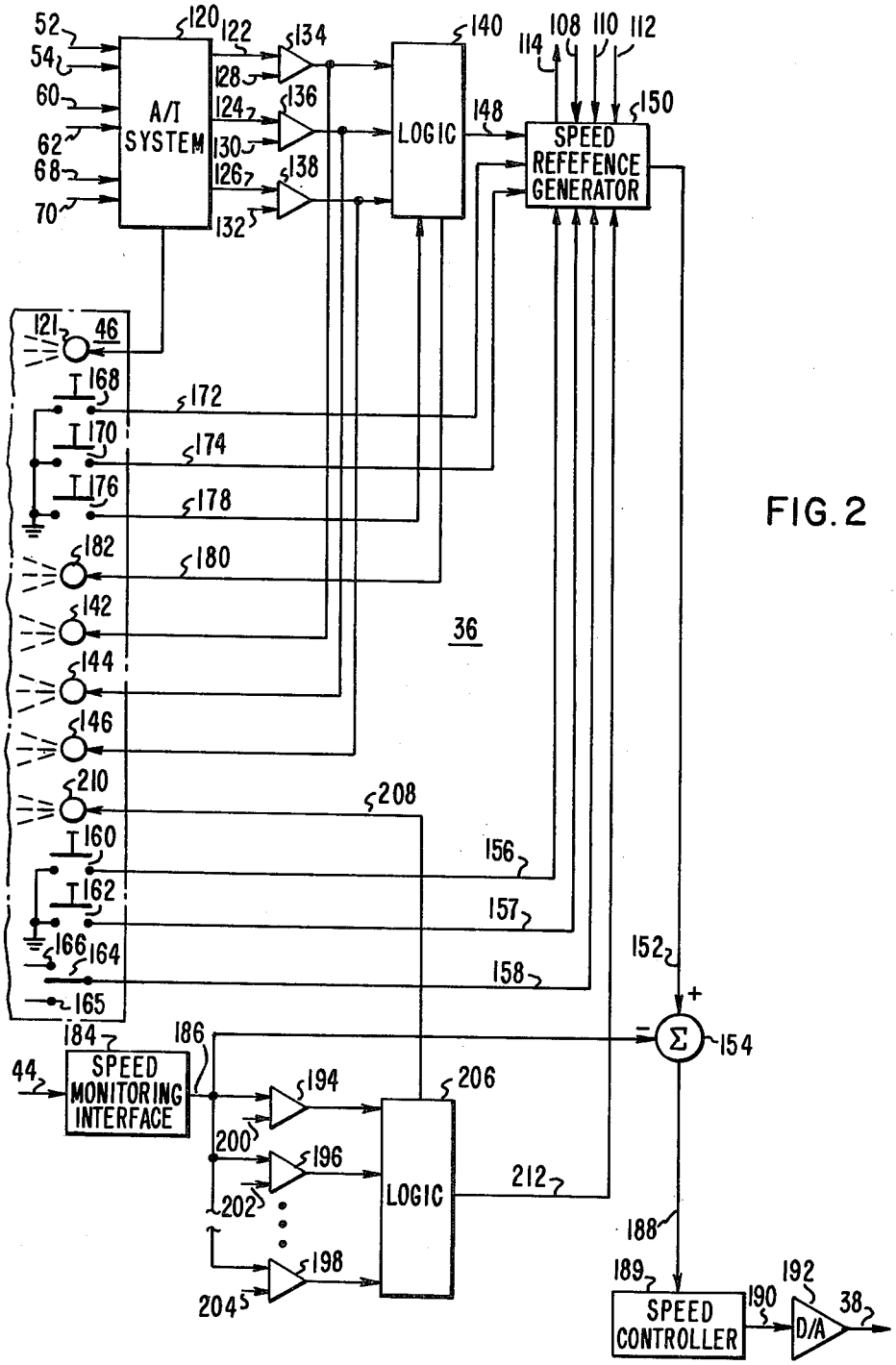
FIG. 2 is a functional block diagram which illustrates the operation of a speed reference controller for use in the embodiment of FIG. 1.

Referring to FIG. 2, the differential temperature measurements conducted over signal lines 52 and 54, 60 and 62, 68 and 70 may be provided to a conventional analog input (A/I) system 120 which may functionally operate to condition the analog temperature measurements against electrical noise and provide single ended equivalent differential temperature signals therefrom for the case in which the speed reference controller is embodied in an analog circuit. For the case in which the speed reference controller is embodied with digital circuitry, which is the preferred embodiment, the differential measurements may be digitized by the analog input system 120 with the use of an A/D converter (not shown) in a manner well known to those skilled in the pertinent art to effect digital words 122, 124, and 126 which are representative of the differential temperature measurements provided to the controller 36 over signal lines 52 and 54, 60 and 62, and 68 and 70, respectively. If an anomaly condition is uncovered in the A/I system 120 the monitor lamp 121 is lit as an indication of this condition.

Functionally, the digital words 122, 124 and 126 are compared with preset temperature limit values 128, 130 and 132, respectively associated therewith utilizing the comparators 134, 136 and 138. An example of a preset temperature limit value compared at 128, 130 and 132 may be on the order of 250° F. Should the comparator functions 134, 136 or 138 detect that an absolute temperature difference measurement corresponding to one of the signal lines 122, 124 or 126 exceeds its corresponding preset temperature limit value, a signal is provided to a logic block 140 and also provided to a respectively corresponding monitor lamp 142, 144, or 146 disposed on the operator's panel 46. In either case, the output signal of any one of the comparators 134, 136 and 138 is indicative of an anomaly condition. The logic block 140 upon detection of at least one output signal from the comparators 134, 136 and 138 provides a hold signal 148 to a speed reference generator function 150.

The speed reference generator 150 is functionally operative to generate a speed reference setpoint signal 152 to a functional summing junction 154. Under controlled conditions, the speed reference generator 150 may accelerate the speed reference signal 152 over signal line 152 to a desired speed demand signal at a selected acceleration value. The speed demand signal is conventionally derived in the speed reference generator 150 in response to the states of the input signals 156, 157 and 158 which are respectively coupled from pushbuttons 160, 162 and 164 disposed on the operator's panel 46. The state 165 of pushbutton 164 determines that a change in speed demand value is requested over signal line 158 to the speed reference generator 150. The state of the pushbuttons 160 and 162 requests over signal lines 156 and 157 either an increase or a decrease in the speed demand value derived in the speed reference generator 150. In the case in which the speed reference controller 36 is controlling the speed of the turbine independently, the pushbutton 164 may be actuated in the position 166 which effects a request over signal line 158 to the speed reference generator 150 that a new acceleration value is to be selected from the panel 46. Thus, increase and decrease pushbuttons 160 and 162, respectively, may be actuated to provide the appropriate signals over signal lines 156 and 157 to cause the speed reference generator to derive a new acceleration value. This will be discussed in greater detail hereinbelow.

In the case in which the turbine acceleration is being governed by the rotor stress controller 72 a signal is provided over signal line 108 to the speed reference generator 150 which causes the speed reference generator 150 to be unresponsive to those signals over signal lines 156, 157 and 158 related to updating the acceleration value derived therein. The speed reference generator 150, in this case, acquires its acceleration value from the plurality of signal lines including 110 and 112 provided thereto from the rotor stress controller 72. These signal lines including 110 and 112 in combination may contain a digitally coded word which is representative of an acceleration value in accordance with some predetermined table. For example, if the signal lines 110 and 112 exhibited the code 0,0, this may represent an acceleration value of 0 or in other words a turbine speed hold condition. Other digital codes over signal lines 110 and 112 may be 0,1; 1,0; and 1,1 which may be representative of acceleration values of 50 RPM/minute, 100 RPM/minute, and 150 RPM/minute, respectively. Additionally provided to the speed reference generator 150 are the states of go and hold pushbuttons 168 and 170, respectively, disposed on the operator's panel 46 utilizing signal lines 172 and 174. The state of an override pushbutton 176 also disposed on the operator's panel 46 is provided to the logic functional block 140 over signal line 178. The logic block 140, in response to a selected override actuation, conducts a signal over signal line 180 to the monitor lamp 182 disposed on the operator's panel 46 as an indication that an override is in progress.

The electrical pulses over signal line 44 are provided to a speed monitoring interface functional block 184 which converts the electrical pulses into a digital word 186 which is representative of the turbine rotating speed in real time. The signal 186 is functionally supplied to the negative input of the summing junction 154 and is therein subtracted from the speed reference signal 152 to produce a speed error signal 188. A conventional speed controller function 189, such as a proportional plus integral function or merely a proportional function, is governed by the speed error signal 188 to generate a valve position signal 190. Since in the preferred embodiment the speed reference controller 36 is a digital controller, the valve position signal 190 will be generated as a digital word and a conventional D/A converter 192 may be used to convert the valve positioning digital word 190 into the needed analog signal 38 which eventually is used to position the steam admission valve 28. The speed signal 186 within the speed reference controller is also submitted to one input of a number of functional comparators 194, 196, and . . . , 198 and correspondingly compared therein with preestablished critical speed zones 200, 202, . . . , 204, respectively. Upon detection that the speed signal 186 has a value within one of the critical speed zones, denoted by signals 200, 202 and 204, the comparators 194, 196, . . . , 198 will output a signal to a functional logic block 206. Upon detection that the speed signal is within at least one of the critical speed zones, the logic block 206 provides a signal 208 to light a monitor lamp 210 located on the operator's panel 46 indicative that the turbine speed is within a critical speed zone and furthermore, the logic block additionally provides a signal 212 to the speed reference generator 150 indicative of the same.

Typically, during a turbine startup operation, the pushbutton 164 is actuated in the position 165 to indicate to the speed reference generator 150 that a new speed demand is desired. Thereafter, pushbutton 162 is actuated to increase the speed demand to the desired value. If the rotor stress controller 72 is governing the acceleration there will be no further inputs from the operator's panel 46 to change the value of the acceleration because the speed reference generator 150 will under these conditions be unresponsive to the signals 156, 157 and 158 should the pushbutton 164 be actuated in the position 166. To increase the present speed reference value towards the desired speed demand value at the acceleration governed by the digital code over signal lines 110 and 112, for example, the go pushbutton 168 is actuated to provide a proposed signal over signal line 172 to the speed reference generator 150. As the speed reference signal 152 is accelerated to the speed demand, the measured turbine speed signal 186 is forced to converge closely to the speed reference signal 152 by the operation of the speed controller 189 which regulates the steam conducted through the steam turbine by positioning the steam admission valve over signal line 38.

During the acceleration of the turbine speed, should a differential temperature measurement as indicated over signal lines 122, 124 and 126 exceed its preset temperature limit value as detected by comparators 134, 136 and 138 a hold signal 148 will be generated by the logic block 140 and provided to the speed reference generator 150. The speed reference generator 150 will respond to this generated hold signal by rendering the acceleration value derived therein to 0 or in effect create a turbine speed holding condition. If it is identified by the comparators 194, 196 and 198 that the turbine speed is being held in one of the preestablished critical speed zones denoted by 200, 202 and 204, the logic block 206 will initiate a runback of the speed reference signal 152 by generating a signal over line 212. The speed reference generator 150, in response to the signal 212, will cause the speed reference signal 152 to run back to a value which is outside a critical speed zone range normally at the acceleration value which it is using to ramp the speed reference signal to the desired speed demand.

Another aspect of the speed reference controller 36 is the capability of overriding a speed reference hold condition caused by a differential temperature exceeding its preset limit value. That is, during a differential temperature related speed reference hold condition, the pushbutton 176 may be depressed to selectively generate an override signal over line 178 to the logic block 140. The logic block 140 responds to the override signal 178 by cancelling the hold condition submitted to the speed reference generator 150 over signal line 148 and permits the speed reference generator 150 to proceed in accelerating the speed reference signal 152 to the desired speed demand at the selected acceleration value. During an override condition the logic block 140 maintains a signal over signal line 180 to light the monitor lamp 182 to indicate to an operator that an override is preset. In addition to the lighting of the override monitor lamp 182 the differential temperature measurement which is causing the out-out limit condition will be exhibited to an operator by the lighting of one of the monitor lamps 142, 144 or 146. It should be made clear that if another differential temperature measurement which has not been overridden exceeds its preset temperature limit value, another of the monitor lamps 142, 144 or 146 will additionally be lit and the functional logic block 140 will cause another speed reference hold by resupplying a signal over signal line 148 to the speed reference generator 150. To override this second temperature related speed reference hold condition, the pushbutton 176 must be redepressed whereby the logical block 140 will cancel the signal over signal line 48 again and permit the speed reference generator 150 to continue ramping the speed reference to the desired speed demand at the selected acceleration value. This same sequence must be followed if a third temperature related speed reference hold presents itself. The override monitor lamp 182 will remain lit indicating that an override condition exists until all of the differential temperature measurements denoted by signals 122, 124 and 126 are below their corresponding preset temperature limit values denoted at 128, 130 and 132, respectively. As the speed reference signal 152 becomes equated substantially to the desired speed demand value a heat soak permissive signal is conducted over signal line 114 to the rotor stress controller 72.

Figure 3:
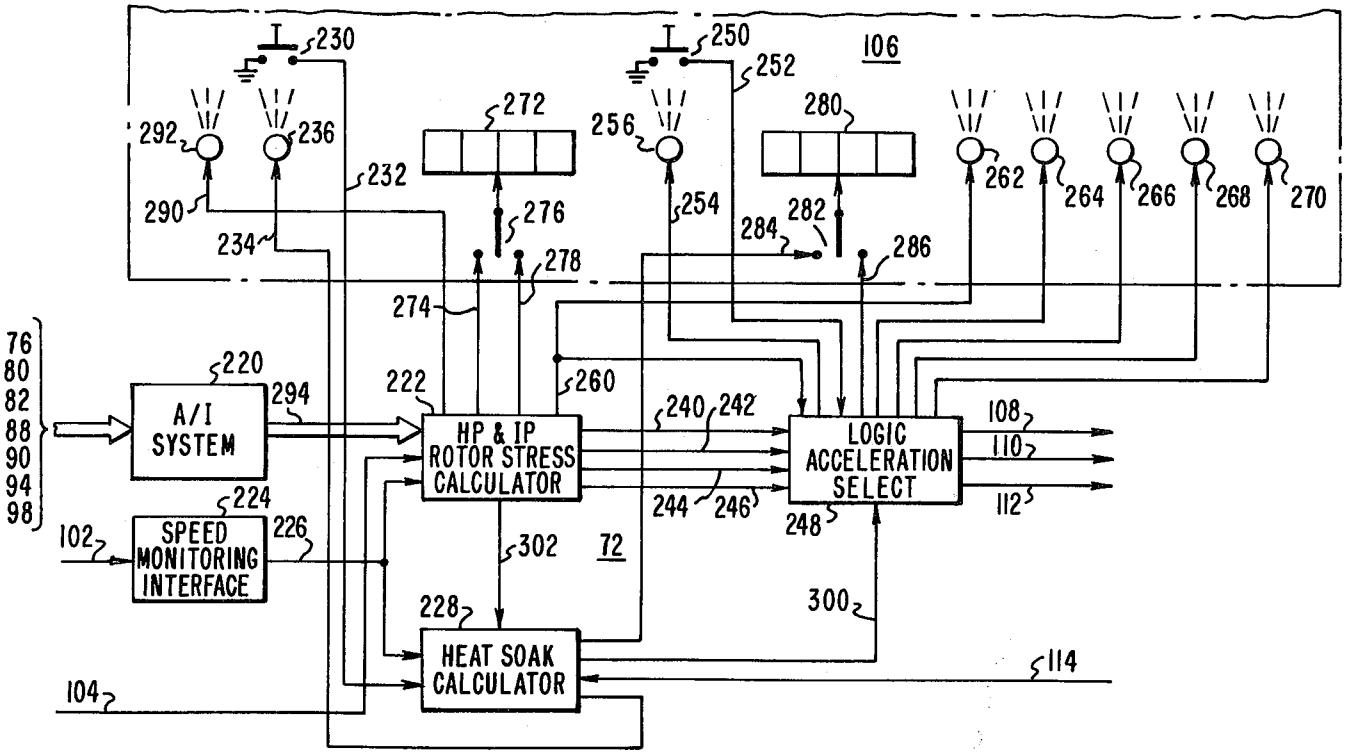
FIG. 3 is a functional block diagram which illustrates the operation of a rotor stress controller for use in the embodiment of FIG. 1.

Referring now to the functional representation of the rotor stress controller 72 as shown in FIG. 3, the analog temperature and pressure representative signals 76, 80, 82, 88, 90, 94, and 98 generated from transducer monitoring points within the high pressure section 10 and intermediate pressure section 12 of the steam turbine system are provided to a conventional analog input (A/I) system 220. Since it is preferred that the embodiment of the rotor stress controller 72 be that of a digital processor, the A/I system 220 converts these input analog measurement signals to a plurality of corresponding digital values 294 which are provided to an HP and IP rotor stress calculator function 222. The electrical pulses representative of steam turbine rotating speed over signal line 102 are provided to a speed monitoring interface function 224 and are conventionally converted therein into a speed measurement digital word 226 which is provided to both the rotor stress calculator functional block 222 and also a heat soak calculator functional block 228. The digital signal 104 which is representative of the status of the main breaker 22 is additionally provided to the rotor stress calculator functional block 222. The status of a heat soak push button 230 disposed on the panel 106 is provided to the heat soak calculator functional block 228 over signal line 232 and in turn a signal 234 is provided to a monitor lamp 236 associated with the heat soak push button 230.

As the rotor stress calculator functional block 222 carries out its computational operations which may be similar to those described in U.S. Pat. Nos. 3,588,265 and 4,029,951 referenced hereinabove, a present and anticipated rotor stress value is derived for that portion of the turbine rotor shaft which is in close proximity to the inlet of the high pressure turbine section 10 and denoted by signals 240 and 242 and a present and anticipated rotor stress is derived for that portion of the turbine rotor shaft wich is in close proximity to the input of the intermediate pressure turbine section 12 which are denoted by the signals 244 and 246. The rotor stress derived signals 240, 242, 244 and 246 are all supplied to a logic acceleration select functional block 248. The status of a rotor stress control push button 250 disposed on the panel 106 is supplied to the logic acceleration select block 248 over signal line 252 and in turn a signal 254 is provided from the block 248 to a monitor lamp 256 associated with the push button 250. Based on the value of the rotor stresses, both present and anticipated, provided to the logic acceleration select functional block 248 and based on the status of the push button 250, the logic acceleration selector 248 will output signals over signal lines 108, 110, and 112 to govern the acceleration of the turbine as controlled by the speed reference controller 36 during startup operations. Once the main turbine breaker 22 is detected as being closed, that is, the steam turbine has reached synchronous speed and electrical power is being supplied to a power system network, a signal 260 will be supplied to the logic acceleration selector 248 and to a monitor lamp 262 located on panel 106 to indicate this condition. If the main breaker condition is that of being closed, the logic acceleration selector 248 will no longer be governing the acceleration of the steam turbine generator as controlled by the controller 36, but will provide supervisory instructions to the operator's control panel 106. For example, certain advisory monitor lamps 264, 266, 268, and 270 all located on the panel 106 will be lit in accordance with the following derived advisory status: hold load, hold rate, increase rate, and decrease rate, respectively.

Certain prespecified values, such as the IP bore temperature and the percent of rotor stress limit, which are computed by the rotor stress calculator functional block 222 may be selectively provided to a numerical display 272 located on the panel 106. As functionally exhibited in FIG. 3, the calculated IP bore temperature signal 274 is provided to one position of a selection function or push button 276 and the percent of rotor stress limit value 278 is presented to the other position of the same selection function 276. Therefore, the selection function 276 may be actuated to select which of the two signals 274 or 278 is desired to be displayed in the numerical display windows at 272 on the operator's panel 106. Another numerical display 280 disposed on the operator's panel 106 may be utilized to display one of the variable's: acceleration, load rate, or time left for heat soak for example. The time left for heat soak value may be provided to one position of a selective function or push button 282 over signal line 284 from the heat soak calculator functional block 228. Either the selected acceleration value or the selected load rate value may be provided over signal line 286 to another position of the selection function 282 from the logic acceleration selector 248 based on the present status of the main breaker determined by signal 260. The selection function 282 may be used to determine which variable will be displayed in the numerical display window 280 of the operator's panel 106. A signal 290 supplied from the calculator functional block 222 is used to light a monitor lamp 292 which indicates to an operator that the rotor stress model is still being initialized and any data being displayed over the panel 106 may be considered invalid. And finally, a signal 114 indicating permission to start a heat soak calculation is applied from the controller 36 to the heat soak calculator functional block 228 of the controller 72.

As power is turned on to the rotor stress controller 72, which is preferably a digital processor, the A/I system 220 begins monitoring the preselected temperature and pressure variables of the stream turbine system and periodically converts them into corresponding digital words which are supplied to the rotor stress calculator functional block 222 over signal lines 294. Initially the rotor stress model used in the calculator function 222 derives a temperature profile across the rotor cross-section at the prespecified points namely the inlet to the high pressure turbine section and the inlet to the intermediate pressure turbine section, for example. It is understood that initialization of this rotor model takes a prespecified amount of time to establish a valid temperature profile across the cross section of the turbine rotor shaft at these predetermined points. In one case, this time may be as long as two hours.

After the rotor stress model has been initialized, the monitor lamp 292 is turned off indicating to the operator that further information displayed on the operator's panel 106 is thereafter valid. To have the rotor stress controller 72 govern the acceleration of the steam turbine as controlled by the speed reference controller 36, the push button 250 must be actuated to request this condition and the logic acceleration selector 248 acknowledges its acceptance of this request by backlighting the monitor lamp 256 correspondingly associated with the push button 250. The acceleration selector 248 when in this state, reacts to the continuously derived rotor stress values presented thereto over signal lines 240, 242, 244, and 246 to derive acceleration limit values in a digital code as presented over signal lines 110 and 112 to the speed reference controller 36. The speed reference controller 36 is requested to accept this digital code for acceleration governing purposes by the signal submitted thereto over signal line 108. In addition, the logic acceleration selector 248 requests the selection function 282 to display the acceleration rate in the numerical display 280. In a similar manner the selection function 276 may be requested to display in the numerical display window 272 either the IP rotor bore temperature or the percent of rotor stress limit as continuously calculated by the rotor stress calculator functional block 222.

At some point in time during start-up operations, the rotating speed of the steam turbine system may be controlled to a predetermined heat soak speed. The heat soak calculator function 228 determines this state and if the permissive signal over line 114 is present, it will initiate a heat soak period during an activated heat soak. The logic acceleration selector 248 is requested by the heat soak calculator functional block 228 over signal line 300 to provide a digital code over signals 110 and 112 representative of a zero acceleration, that is a speed hold condition. Also during a heat soak period, the monitor lamp 236 is backlighted by the signal generated over signal line 234 and the select function 282 is requested to display the time left for the heat soak period in the numerical display window 280.

Normally, a heat soak period lasts for a predetermined time during the turbine start-up operation. During this predetermined heat soak period, the select function 276 is requested to display the calculated IP rotor bore temperature in the numerical display window 272. In addition, the IP rotor bore temperature which is being continuously calculated by the rotor stress calculator functional block 222 is additionally supplied to the heat soak calculator 228 over signal line 302. As the predetermined heat soak time period is terminated, the heat soak calculator block 228 checks if the calculated IP rotor bore temperature from the rotor stress model is at a sufficient value to continue accelerating the turbine rotor shaft to an increased speed condition. If the calculator IP bore temperature is insufficient in value, the heat soak period will be sustained until such time at which the IP bore temperature calculated from the rotor stress model achieves a sufficient value as determined by the heat soak calculator 228. Thereafter, the logic acceleration selector 248 will be requested to proceed in its acceleration governing operation in accordance with the rotor stress values provided thereto over signal lines 240, 242, 244 and 246.

A heat soak period may also be selected at some speed within a given speed interval below the predetermined heat soak speed by selectively actuating the push button 230 to provide a heat soak request signal over signal line 232 to the calculator 228. An acknowledgment of this request is in turn provided to the monitor lamp 236 over signal line 234. The same operation will be performed by the heat soak calculator as described above in either case. At the termination of the heat soak period, the selection function 282 is requested to provide the acceleration value derived by the selector 248 to the numerical display 280. Either the presently calculated IP rotor bore temperature value or the percent of rotor stress limit may be selected for display in the numerical window 272. It is worth noting that a heat soak period may not be actuated unless the push button 250 has been selectively actuated to provide acceleration governing control by the rotor stress control 72.

After the steam turbine system has been brought to synchronous rotating speed the main breaker is closed to permit electrical power to be supplied to the power system load. At this time the selector 248 is made aware of this condition by signal 260 and hereafter opens in signal lines 108, 110 and 112 to inhibit further acceleration governing of the speed reference controller 36. Upon breaker closure the monitor lamp 262 will be lit and digital load rate supervisory instructions will be provided to an instructor using the monitor lamps 264, 266, 268, and 270 as described hereinabove.

Figure 4:
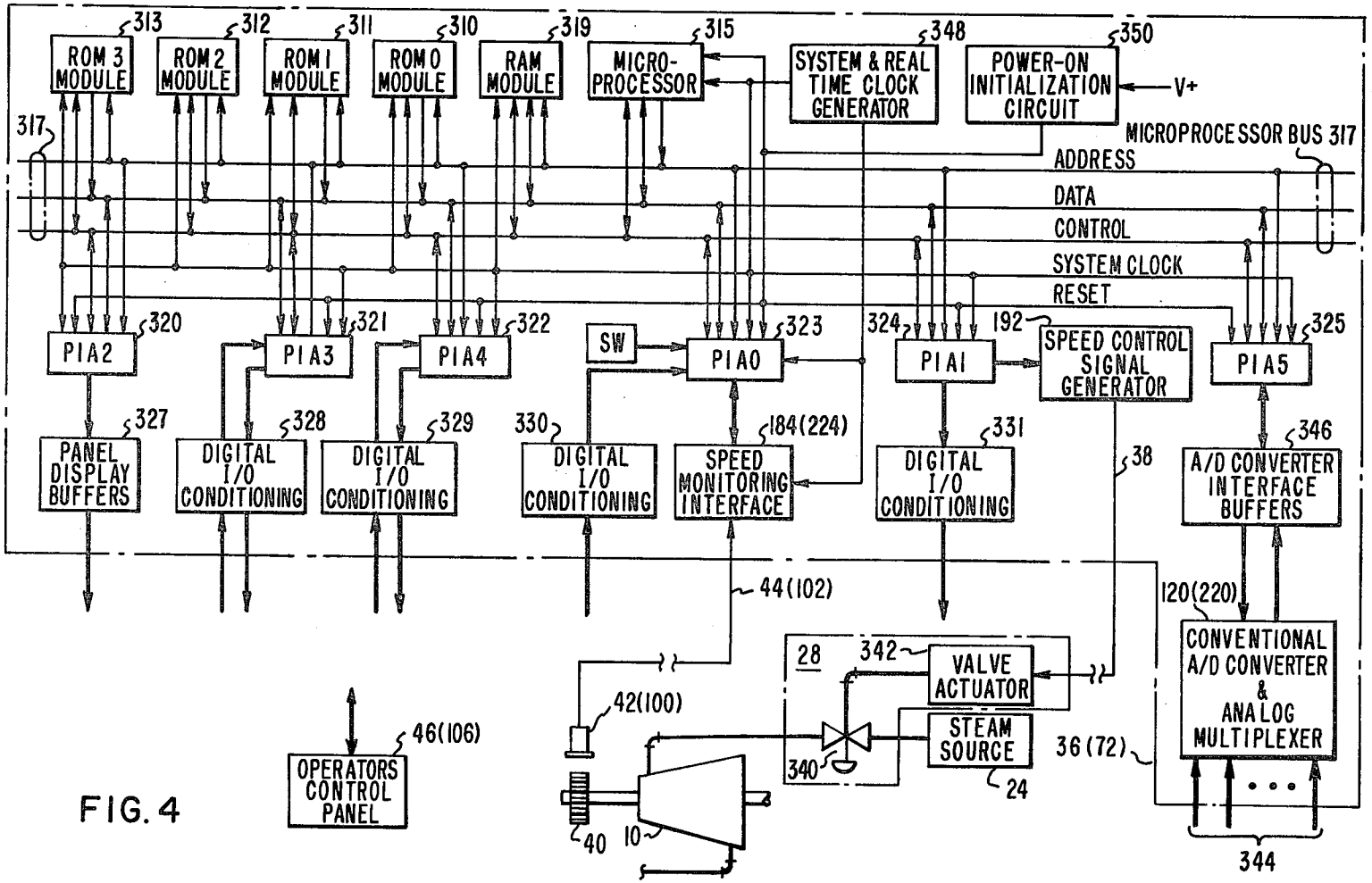
FIG. 4 schematically depicts a microprocessor-based controller suitable for embodying the functions of the controllers as shown in FIGS. 2 and 3.

The controllers 36 and 72 as functionally described in FIGS. 2 and 3, respectively, are preferably embodied as a microprocessor based digital processing system as shown in FIG. 4. Since both controllers 36 and 72 are of similar construction and operation with respect to their structural embodiment, a description of only one controller will be presented for the purposes of this specification. Instruction and data words may be permanently programmed in a plurality of ROM devices such as that shown at 310 through 313. These instructions and data words are processed by a microprocessor 315 utilizing a microprocessor bus 317 for the exchange of information therebetween. A temporary memory module 319 and a plurality of digital interface modules 320 through 325 are additionally coupled to the microprocessor bus to allow exchange of information between the microprocessor and other modules during the instruction processing operation of the microprocessor 315.

The digital interface module 320 has coupled to its output a panel display buffer which amplifies the output signals of the interface 320 to drive numerical displays such as that shown in FIG. 3 at 272 and 280 on the operator's control panel 106. Digital interface modules 321, 322, 323, and 324 have coupled to their outputs or portions thereof digital I/O conditioning circuits 328, 329, 330, and 331, respectively. The digital I/O conditioning circuits described above provide amplification and buffering for input and output signals to the controllers 36 and 72 for the purposes of lighting lamps on the panels 46 and 106 and buffering the input push button information from said panels. Additionally coupled to the digital interface circuit 323 is a speed monitoring interface 184 (224) which receives the electrical pulses form the electromagnetic pickup 42 (100) conducted over signal line 44 (102). Additionally coupled to the digital interface circuit 324 is a speed control signal generator which primarily performs the function of a D/A converter 192 as functionally shown in FIG. 2. The output of the signal generator 192 is that which is used to control the positioning of the steam admission valve 28 which comprises a mechanical valving portion 340 and a hydraulic valve actuator portion 342. An A/I system conventionally comprising an analog multiplexer cascaded downstream with an A/D converter is represented by the block 120 (220). The inputs to the A/I system 120 (220) are those temperature and pressure representative signals as shown and described in connection with the functional blocks FIGS. 2 and 3. An A/D converter interface buffering circuit 346 couples the conventional A/I system 120 (220) to the digital interface circuit 325 for purposes of transferring the digitally converted measurements to the microprocessor-based controller 36 (72). A system and real time clock generator 348 provides the timing signals to the microprocessor 315 and digital interface circuits to provide the necessary synchronization between the instruction processing of the microprocessor 315 and the exchange of information over the microprocessor bus 317 to the permanently programmed memories 310 through 313, temporary storage memory module 319 and the digital interface circuits 320 through 325. Additionally disposed in the microprocessor-based controller 36 (72) is a power-on initialization circuit which provides a reset signal to the various memory elements therein which are initialized with predetermined initial digital words to begin the instruction processing operation.

Typically, the operation of the microprocessor based controller 36 (72) begins with turning the power on. The power-on initialization circuit 350 responds by initializing the prespecified memory registers in the controller to their predetermined initial digital states. The microprocessor 315 then begins instruction execution at some initial address point in the permanently programmable memory. This instruction processing comprises operating the speed monitoring interface 184 (224) to convert the electrical speed pulses input over signal line 44 (102) into speed measurement digital words which are taken in through the digital interface circuit 323 and provided in the temporary memory module 319; operating the digital interface modules 321, 322, 323, and 324 to monitor push button status and the status of other digital inputs and to update digital output signals for the purposes of lighting lamps on panel or energizing relays and other digitally related operations; operating digital interface 320 to provide the numerical information to the displays disposed on the operator's control panel 46 (106) like those shown at 272 and 280 in FIG. 3; operating the digital inferface 324 to output digital control words which are converted by the signal generator 192 to provide a position control signal 38 which positions the steam admission valve 28 to regulate steam through the steam turbine system; and operating digital interface module 325 to periodically scan the digitized analog inputs 344 and to update prespecified memory registers with the temperature and pressure vairables which are dynamically changing during the turbine speed and load controlled start-up opertion.

The structure and operation of the microprocessor based controllers 36 and 72, as described in connection with FIG. 4 above, is similar to that which has been disclosed in the U.S. Pat. No. 4,099,237 issued to Zitelli et al. on July 4, 1978, said Patent being incorporated by reference herein for the purposes of providing a more detailed understanding of the operation of such a microprocessor based control system.

FIGS. 5A, 5B, 5C, and 5D exemplify a method by which the instructions and data words may be permanently programmed in the ROM memory devices 310 through 313 and the sequence in which they may be executed by the microprocessor 315 in cooperation with the other interface elements which are disposed in the speed reference memory controller 36. Starting with FIG. 5A, as power is turned on to the controller 36, a block of instructions 400 is executed to initialize the controller memory elements to their prespecified initial digital states. The microprocessor 315 then sits in a wait-for interrupt loop shown at 402 waiting for a real time controller interrupt signal which may be generated from the clock generator 348. Each time an interrupt is received, programming execution begins at the program instruction block 404. In block 404 the panel push buttons are scanned, the contact closure inputs CCI's are scanned and the analog input system variables are digitized and their respective memories are updated. In the present embodiment, certain portions of the instructions are executed during odd interrupt periods and other portions are executed during even interrupt portions. This is shown in the flow chart at 406.

Assuming an odd interrupt period, then instruction processing continues at the instruction block 408 where a speed control subroutine is conducted. This speed control subroutine is similar to that which is depicted in FIG. 2 at summing junction 154, error signal 188, speed controller function 189 and digital output word 190. Each time a new value position control word denoted as NVP is derived it is compared with a previous valve position control word denoted as PVP. Their difference is compared with a predetermined limit in instructional block 410. If the currently derived valve position control word NVP is within the incremental limit of the previously derived control word PVP, then instruction execution continues at the instruction block 412 in which the internally derived position control word 190 is output to the D/A converter of the signal generator 192 to be supplied to the steam admission valve for positioning thereof. However, if the currently derived valve position control word NVP is beyond the predetermined incremental limit from the previously derived valve position control word PVP, then the speed control is reverted to a manual state by the instructional block 414 and certain of the logical variables are clear to their appropriate states utilizing instructional block 416. In either case, program execution is returned to a wait-for the next interrupt state which is 402.

Figure 5A:
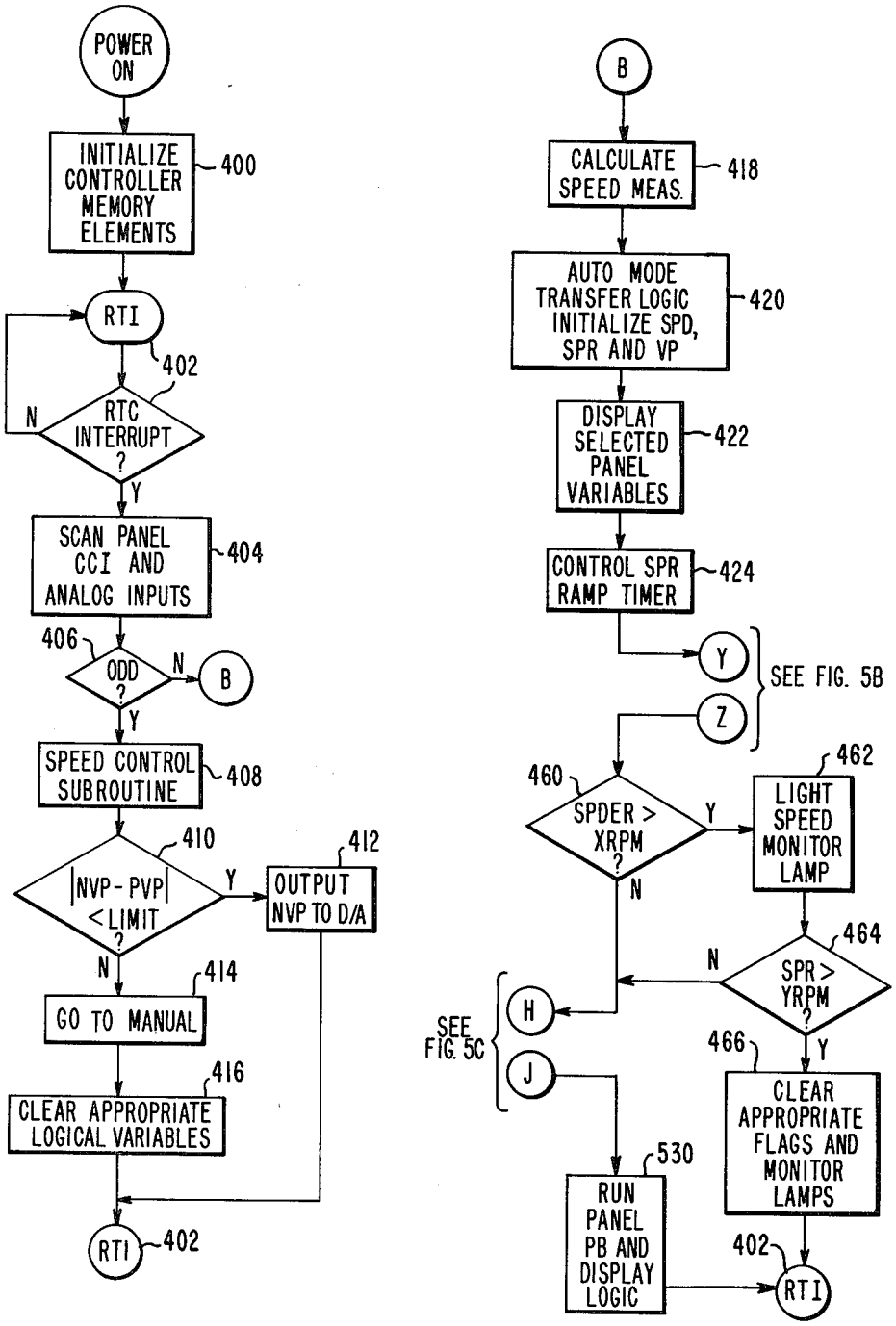
FIGS. 5A, 5B, 5C and 5D are flow charts of sequentially ordered blocks of instructions illustratively characterizing the operation of a permanently programmed microprocessor-based speed reference controller as functionally and structurally depicted in FIGS. 2 and 4, respectively.
Figure 5B:
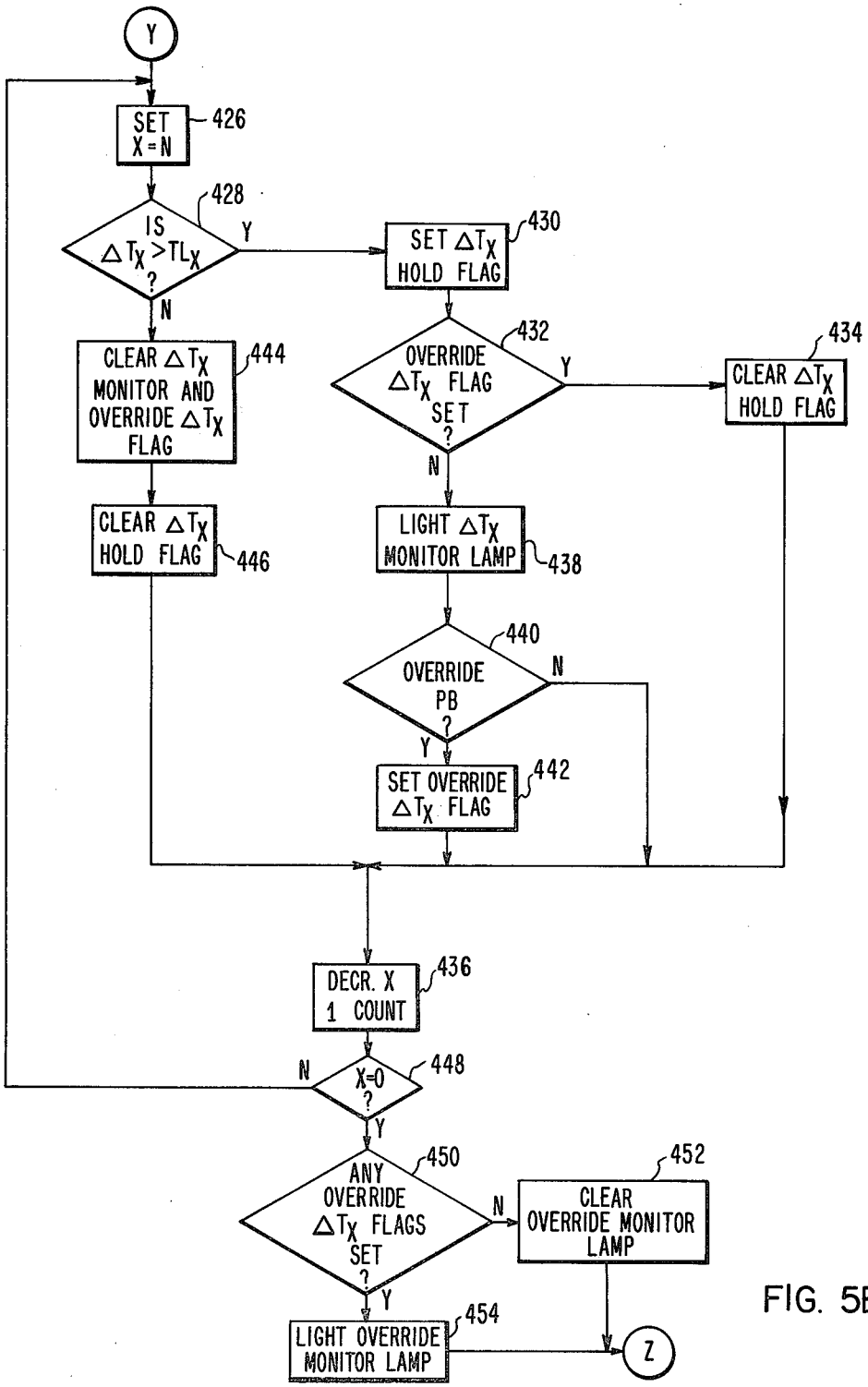

Should the next interrupt be related to an even interrupt period, program execution begins at the point in the flow chart of FIG. 5A denoted as B. Thereafter, a new speed measurement is calculated from the speed measurement digital words which have been temporarily stored in the memory module 319 being received from the speed monitoring interface 184. Immediately subsequent to the initialization or power-on of the controller 36 an auto-mode transfer is performed in the functional block 420 along with initializing the speed demand value denoted as SPD, and a speed reference value denoted as SPR and the valve position denoted as VP. In subsequent even interrupt instruction processing periods the instructional block 420 is not executed if an automatic mode transfer has been completed. After 420, instructional processing continues at 422 where certain selected variables are displayed on the panel 46. In the next instructional block in the sequence 424, the ramp timer which is used to adjust the speed reference value is initialized. Instruction execution thereafter encompasses a subroutine between the denoted alpha characters Y and Z shown in FIG. 5B.

The number of differential temperatures monitored in the steam turbine system denoted as N is set at instructional block 426. In a decisional block 428, one of the differential temperature measurements $\Delta T_X$ is compared with its preset temperature limit value denoted as $TL_X$. If the temperature measurement is greater than its respective temperature limit value, then a hold flag associated with that temperature measurement is set in instruction block 430. Next, it is determined if an override has beem requested associated with this temperature measurement being out-of-limits. If an override has been requested, the temperature hold flag is cleared in the instruction block 434 and program execution is continued in block 436. Otherwise, the monitor lamp associated with the differential temperature which is out-of-limits is lit by the instructional block 438. It is next determined if the override push button has been depressed in decisional block 440; and if so, an override flag associated with the differential temperature measurement being out-of-limits is set in instructional block 442. Otherwise, instruction programming will continue at block 436.

If it has been determined that the differential temperature measurement being evaluated is not beyond its preset temperature limit value in the instructional block 428, then any monitor lighting or override flag setting being set as a result of it previously having been outside its preset temperature limit value will be cleared by the instructional block 444. In addition, any temperature hold flag associated with said temperature measurement will also be cleared by instructional block 446 and instructional execution will continue at block 436.

The instructional blocks 436 and 448 cause the previously described subroutine to be re-executed for each differential temperature measurement being monitored. Once this has been completed the decisional block 450 determines if any override flags still remain set. If not, the override monitor lamp shown at 182 in FIG. 2 is cleared by instructional block 452. If an override flag remains set, then the override monitor lamp 182 is set by instructional block 454. In either case program execution is continued at that point denoted by Z.

The decisional instructional block 460 compares the most currently derived speed error calculated from the instructional block 408 with a predetermined error limit denoted as X RPM. Should the speed error be within limits, then instruction execution continues at that point denoted as H, otherwise, a speed monitor lamp located on the operator's panel 46 is lit by the instruction of block 462 and the current value of speed reference denoted as SPR is compared with a predetermined speed reference value denoted as Y RPM. Typically this value is on the order of 3400 RPM for those machines which have a synchronous speed value of 3600 RPM. If it is determined that the current value of speed reference is less than Y RPM, then program execution will again continue at point H. Otherwise appropriate flags and monitor lamps associated with this event will be cleared by instructional block 466 and instruction execution will be returned to the wait-for interrupt subroutine shown at 402.

Figure 5C:
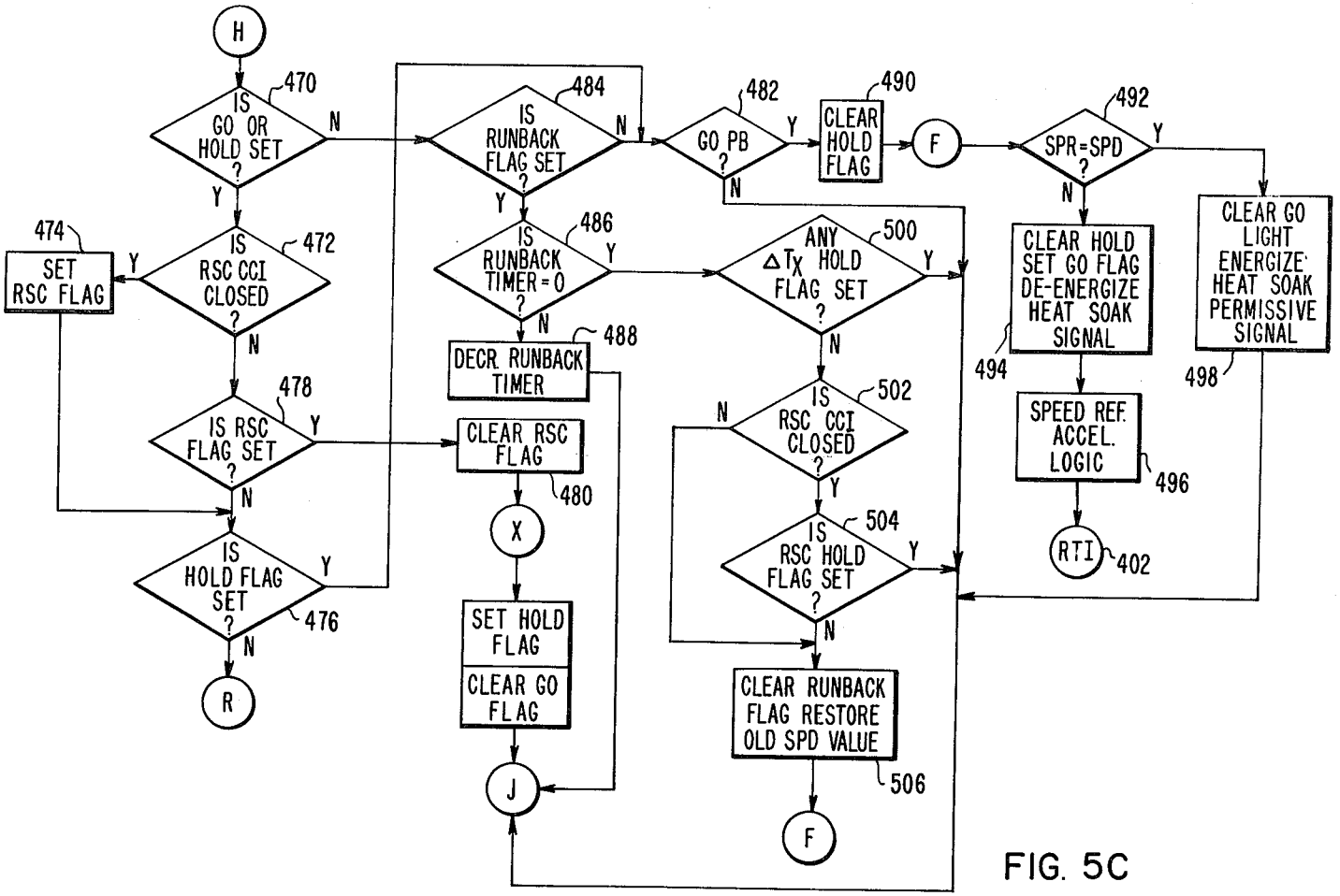
Figure 5D:
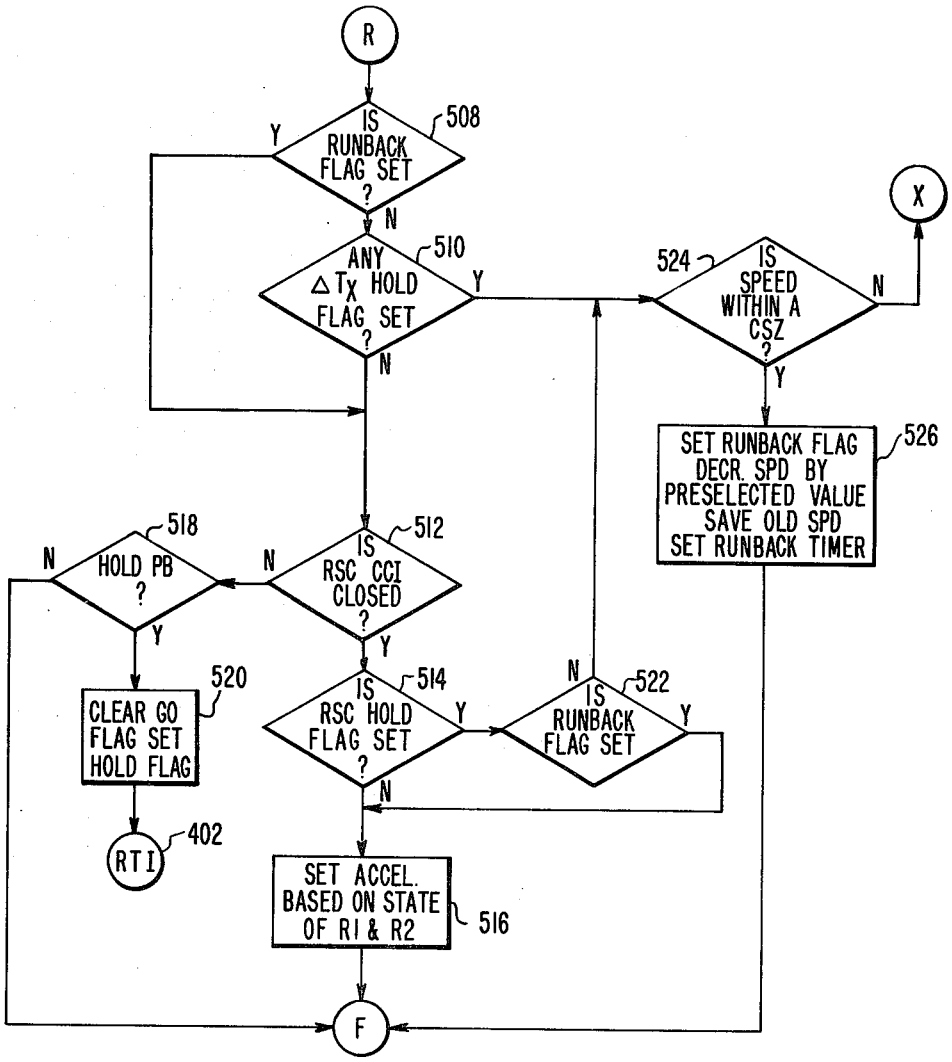

The instructional blocks as shown executed between the points H and J which are exhibited in FIGS. 5C and 5D relate primarily to the governing of the speed reference signal within the controller 36. Referring now to FIG. 5C, the decision block 470 determines if a GO or HOLD push button has been selectively actuated. If the decision of 470 is true, it is next determined in 472 if the rotor stress controller of 72 is requesting over signal line 108 to govern the speed turbine acceleration and if so, the RSC flag is set by instruction 474 and instructional execution continues at decision block 476. Otherwise, it is determined if the RSC flag had previously been set by decision block 478 and if so, the RSC flag is cleared in instruction block 480 and program execution continues at point X. If the RSC flag had not been set, then instruction block execution continues at 476 wherein it is determined if a hold flag has been set. If the decision of block 476 is true, then program execution continues at functional block 482. Otherwise, execution continues at that point denoted by R.

Going back to decisional block 470 and assuming that the decision was false, the next instructional block executed will be 484 wherein it is determined if a runback flag has been set. If decision 484 is true, it is next determined if a runback timer is equal to 0 in block 486. If the runback timer is not equal to 0, it is decremented by instructional block 488 and program execution continues at point J. If the runback flag is determined to have been set by block 484, it is next determined if the GO push button has been depressed in 482. If 482 is determined false, then program execution again continues at point J. Otherwise, the HOLD flag which may have been set is cleared by instruction 490 and the current speed reference value is compared with the desired speed demand value in decision block 492. If the current speed reference value is found not substantially equal to the desired speed demand value, then the GO flag is set and the heat soak permissive signal denoted at 114 in FIG. 2 is deenergized by instructional block 494. Thereafter, an instructional block 496 accelerates the speed reference towards the desired speed demand. After execution of 496, the program execution is continued at the wait-for interrupt loop at 402. Should it be determined that the current speed reference signal has been substantially equated to the desired speed demand signal by block 492, the GO monitor lamp is lit and the heat soak permissive signal 114 is energized by instructional block 498. Program execution thereafter is continued at point J.

Returning to the decisional block 486, if the decision is true, then the program execution determines if there is any differential temperature hold flags set in block 500. If so, program execution is continued at point J; otherwise, it is determined if the rotor stress controller 72 is requesting to govern the speed acceleration in block 502. If so, it is next determined in block 504 if a RSC hold flag has been set. If both 502 and 504 are true, then program execution again continues at point J. Should either decision block 502 or 504 be false, then the runback flag is cleared and an old speed demand value which had been previously stored is restored as the desired speed demand value in instruction block 506. Program execution thereafter continues at point F.

Returning to point R as shown in FIG. 5D, it is determined in block 508 if a runback flag has been set. If not, it is next determined in block 510 if a differential temperature-related hold flag has been set. If either decision block 580 is determined true or if decision block 510 is determined false, program execution is continued at decision block 512 wherein it is identified if the rotor stress controller 72 is requesting to govern the speed acceleration as determined by the state of signal line 108. If so, it is next determined if the RSC hold flag has been set in decision block 514. If the decision of block 514 is false, the acceleration is set based on the states of the signals R1 and R2 which are respresentative of the states of the signal lines 110 and 112 shown functionally in the FIGS. 2 and 3 above. Instructional block 516 performs the acceleration setting and thereafter program execution is continued at point F. If the rotor stress controller 72 is not requesting speed acceleration control as determined through block 512, the next instruction 518 in sequence determines if the hold push button has been depressed on the operator's panel 46. If 518 is determined true, then the GO flag is cleared and the hold flag is set by instructions 520 and program execution is returned to the wait-for interrupt loop at 402; otherwise, program execution is continued at point F. If a RSC hold flag is set as determined by block 514, the next instruction 522 in the sequence determines if the runback flag is set and if so, the instructions at block 516 are executed. If either block 510 is determined true, or if instruction block 522 is determined false, the next instructional block in the sequence is 524 wherein it is determined if the turbine speed is within a critical speed zone denoted as CSZ. This comparison of 524 is depicted functionally by the comparators 194, 196 and 198 as shown in FIG. 2. If the turbine speed is not within a critical speed zone, program execution is continued at point X; otherwise, the runback flag is set, the desired speed demand is decremented by a preselected value, the present speed demand is saved and the runback timer is activated by the instructional block 526. After executing 526, the instruction block starting at point F are next executed. Returning now to the flow chart of FIG. 5A at point J, a set of instructions are executed at point 530 to monitor the panel push buttons and to update the displays on the panel 46. After executing these instructions, the microprocessor sits at the wait-for interrupt loop shown at 402.

It is understood that the flow charts exhibited and described in connection with FIGS. 5A, 5B, 5C and 5D are merely provided as an exemplary program which may be permanently stored in the plurality of ROM modules of the microprocessor base system as described in connection with FIG. 4 hereinabove. It is further understood that the programming of the instructions and data words in the ROM modules of the speed reference controller 36 as related to the flow charts of FIGS. 5A, 5B, 5C and 5D may be performed in a well-known manner by any skilled prgrammer acquainted with the pertinent art of microprocessor programming. In addition much of the detail associated with certain conventional instructional blocks such as initialization panel scanning, analog input processing, digital input and output processing, monitoring and displaying of panel variables, and the like are not described in the present specification. However, most of these details are disclosed in a copending application Ser. No. 787,636, now U.S. Pat. No. 4,133,615, which has been filed on Apr. 14, 1977 by Zitelli et al. which is incorporated by reference herein for the purposes of providing a more detailed description for better understanding these subroutine operations.

Figure 6A:
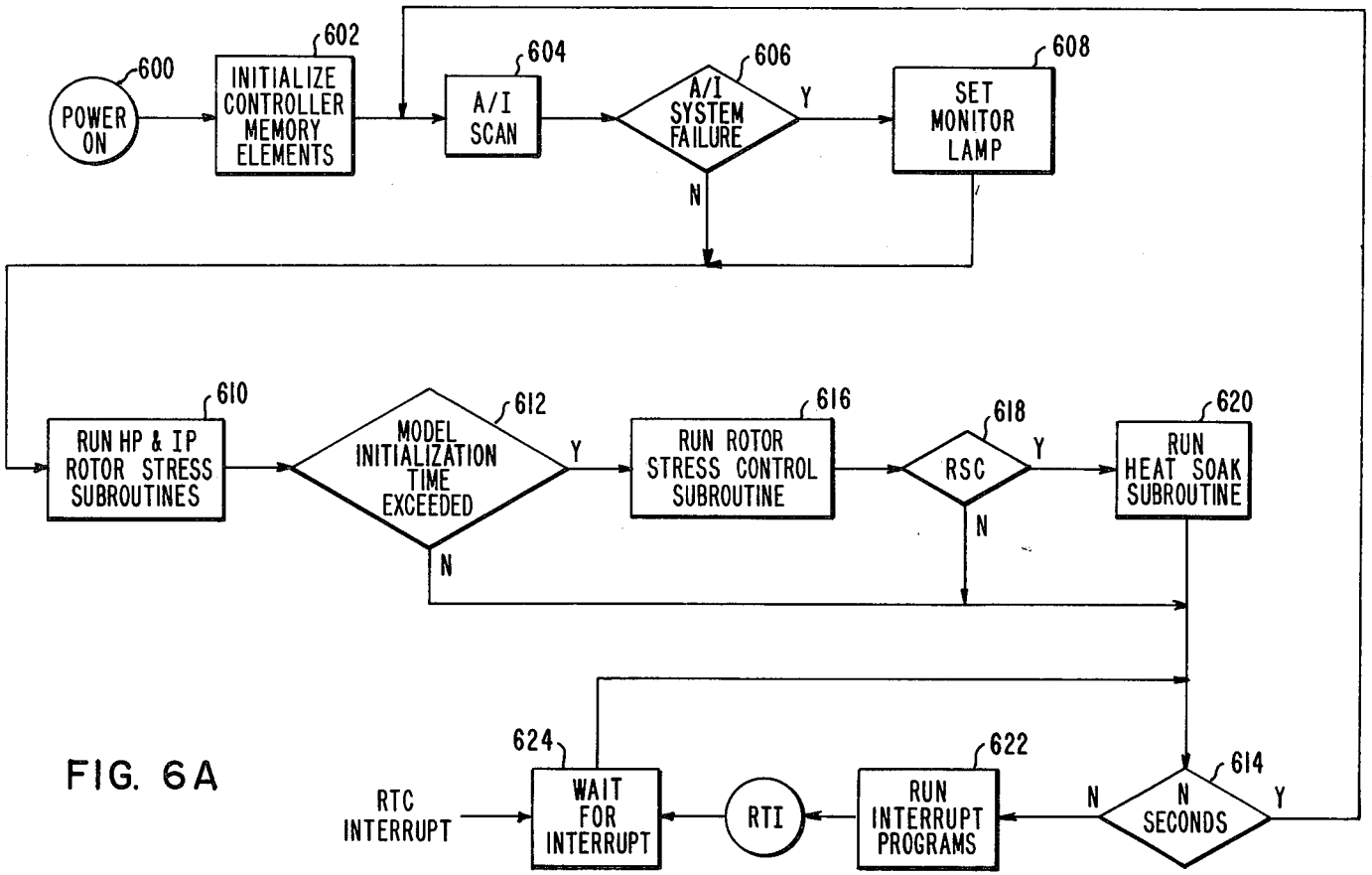
FIGS. 6A, 6B and 6C are flow charts of sequentially ordered blocks of instructions illustratively characterizing the operation of a permanently programmed microprocessor-based rotor stress controller as functionally and structurally depicted in FIGS. 3 and 4, respectively.
Figure 6B:
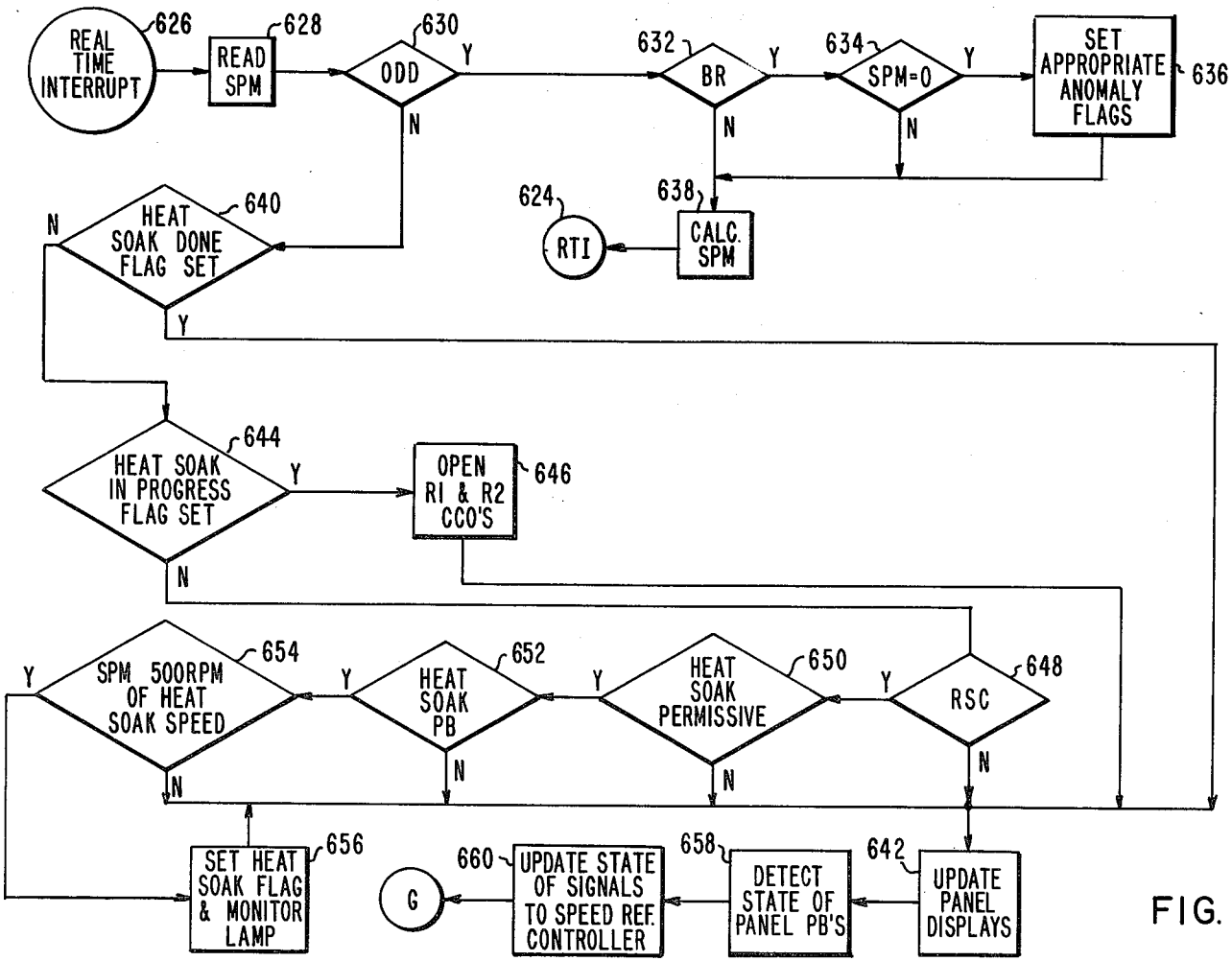
Figure 6C:
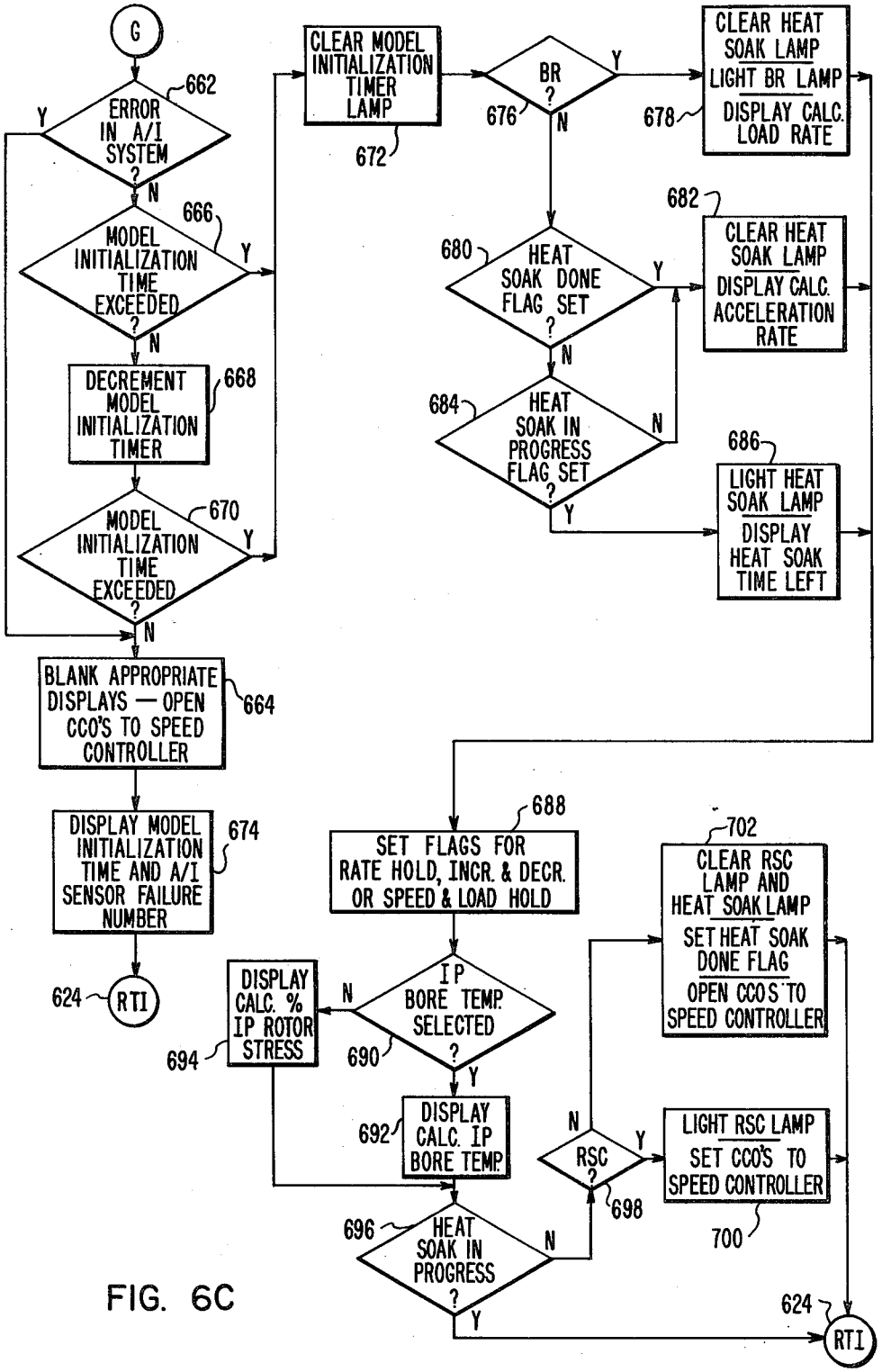

The flow charts depicted in FIGS. 6A, 6B and 6C exhibit exemplary instructional blocks and sequencing thereof which may be suitable for operation of a microprocessor-based rotor stress controller 72 as depicted in FIG. 4 in connection with the functional descriptions associated with FIG. 3. To start with then, power is turned on at 600 and similar to the controller 36 certain prespecified controller memory elements are initialized to their predetermined digital states by the instructional block 602. Next the temperature and pressure representative signals conducted to the A/I system 220 are scanned and their digitized values are used to update predetermined registers in the temporary memory module 319 by the instructions of block 604. Thereafter, it is determined if a failure has occurred in the A/I system by decisional instruction 606. Such failures may comprise an input analog signal being out of limits, an A/D conversion not completed with a prespecified time, or the inability of the system 220 to digitize the analog inputs in the preferred sequential manner. If a failure is detected, such as one of those previously described, then a monitor lamp may be set on the operator's panel 106 to indicate to an operator that rotor stress controller data displayed on the panel 106 may be invalid. Otherwise, the conventional high pressure and intermediate pressure turbine section rotor stress calculation subroutines are conducted by the instructional block 610.

As has been described above there is associated with the rotor stress model an initialization time required to develop the temperature profile across the rotor cross section at predetermined points along the rotor shaft. Next decisional block 612 determines if this initialization time has been exceeded. If not, program execution is continued at decision block 614. If the initialization time is completed constituting valid calculations from the rotor stress subroutines of block 610, then a conventional rotor stress control subroutine associated with selecting acceleration limits based on the rotor stress calculations of block 610 is performed by the instructions of block 616. It is next determined in decision block 618 if the push button 258 on operator's panel 106 has been selectively actuated to request that the rotor stress controller 72 governs the speed acceleration as controlled by the speed reference controller 36. If the decision of block 618 is false, program execution continues at 614; otherwise, a conventional heat soak subroutine as described in connection with functional block 228 of FIG. 3 is next conducted by the instructions of block 620. In the present embodiment, it has been determined to execute the aforementioned described instructions every N seconds, say 5 second for example. Decision block 614 determines if the N seconds has elapsed since the last execution of the aforementioned described instructions. If this is the case, then the instructions 604 through 620 are re-executed; otherwise, execution continues at block 622, the instructional blocks of which are depicted in FIGS. 6B and 6C. After execution of the instructional block 622, the microprocessor reverts to a wait-for interrupt loop at 624. As the microprocessor receives each interrupt, the decisional block 614 is executed and depending on its logical decision, execution is continued at either block 604 or block 622.

Referring to FIG. 6B at each real time interrupt detected at block 626, a read speed measurement data word into memory from the speed monitoring system as shown in FIG. 4 is conducted by the instruction 628. Similar to the sequential instruction execution pattern of the speed reference controller 36, portions of instructions will be executed partitioned between odd and even periods in relation to the real time interrupts. This is determined by the decisional block 630 during the reception of each interrupt.

During an odd interrupt period, it is determined in block 632 if the main breaker is closed. If so, another question is asked by decisional block 634 to establish if the calculated speed measurement is substantially 0. If both of the decisional blocks 632 and 634 are true, then appropriate anomaly flags will be set by instructional block 636. After execution of block 636 or if either of the decisional blocks 634 or 632 is rendered false, program execution will continue at instruction 638 wherein a current speed measurement value is calculated. Program execution thereafter is returned to the wait-for interrupt loop at 624.

During an even interrupt period or multiples thereof, decisional block 640 is initially executed. In 640, it is determined if a heat soak done flag is set and if so, program execution continues at instructional block 642. Else, it is next determined in decisional block 644 if a heat soak in progress flag is set, and if this be the case, the R1 and R2 CCO's associated with the signal lines 110 and 112 are open circuited which is representative of the signal code 0,0 which consitutes 0 acceleration or essentially permits the rotor stress controller 72 to govern the speed reference controller 36 in a speed hold condition. After executing instructional block 646 program execution is continued at 642. If neither decisional block 640 nor 644 is identified as being true, then it is next determined if the rotor stress controller 72 has been selectively actuated by the depression of the push botton 258 as shown functionally in FIG. 3. If it is determined that the rotor stress controller 72 has been selectively actuated to govern the speed acceleration of the speed reference controllerr 36, then it is next determined logically in sequence in decisional blocks 650, 652 and 654 if the heat soak permissive signal is provided over signal line 114 from the speed reference controller 36, a heat soak push button has been depressed, and the most currently calculated speed measurement is within 500 RPM of a predetermined heat soak speed, respectively. If all of the decisions 650, 652 and 654 are true, then the heat soak flag is set and the heat soak monitor lamp located on the panel 106 is lit by instructions of block 656. After executing block 656 or if any of the decisional blocks 650, 652, or 654 are determined to be false, program execution is continued at block 642. The next sequence of instructional block 642, 658, and 660 provides an update of panel displays including the numerical displays 272 and 280 and the monitor lamps functionally described in connection with the panel 106 of FIG. 3, monitoring of the state of the panel push buttons, and updating the state of the signals 108, 110 and 112 provided to the speed reference controller 36, respectively. Program execution then continues at point G in the flow chart exhibited in FIG. 6C.

Referring now to FIG. 6C, in instructional block 662 it is determined if an error is present in the A/I system 220 in a similar manner as that described in connection with the instructional block 606. If an error is detected, program execution continues at block 664; otherwise, it is next determined if the model initialization time has been exceeded in decisional block 666. If not, the initialization timer is decremented by the instruction of block 668 and it is again determined if the model initialization time has been exceeded in decisional block 670. Should either block 666 or 670 be true, block 672 is next executed. Otherwise, the rotor stress model initialization time is not exceeded indicating that the display rotor stress associated variables on the display panel may be invalid. In this state, prespecified appropriate displays are blanked and the CCO's controlling the states of the signals 108, 110 and 112 provided to the speed reference controller 36 are open circuited by the instructional block 664. In the next instructional block 674 in the sequence, the model initialization time is displayed in the numerical display window 272 on the panel 106 and should there be a sensor failure, then the number of the sensor which has failed may likewise be displayed on the panel 106 in an appropriate display. Then, program execution will continue at the wait-for interrupt loop at 624.

In instructional block 672, the model initialization timer lamp will be cleared indicating to the operator that the rotor stress model has been initialized and the display variables are now considered valid. Next in sequence, it is determined if the main breaker has been closed in instruction 676. If this is the case, then the heat soak lamp is cleared, the breaker lamp is lit and the calculated load rate is displayed in the numerical display window 280 as shown in FIG. 3 using the instructions of block 678. If the breaker is not closed, then it is determined if a heat soak flag is set in decisional block 680. If this be the case, then the heat soak lamp is cleared and the calculated acceleration rate is displayed in the numerical display window 280. If the heat soak done flag is not set, it is next determined by the decisional block 684 if the heat soak in progress flag is set. If not, the instructions of block 682 are executed; otherwise, the heat soak lamp is lit and the heat soak time to go is displayed in the numerical display window 280 of panel 106 utilizing the instructions of block 686. After executing either block 678, 682 or 686, program execution continues at block 688. In 688, appropriate flags are set for rate hold, rate increment and rate decrement or speed and load hold are set in accordance with the determined states of the steam turbine system and rotor stress controller. In the next block executed in sequence 690, it is determined if the IP bore temperature has been selected to be displayed in the numerical display window 272 by the select actuator 276 as shown functionally in FIG. 3. If it has, then the most current calculated IP bore temperature value is displayed in the numercial display window 272. Otherwise, the display window 272 will contain the most current calculated percent IP rotor stress value as instituted by the instructions of block 694. After executing either block 692 or 694, it is next determined if a heat soak is in progress by the decisional block 696. If 696 is true, then program execution is continued at the wait-for interrupt loop at 624. Otherwise, it is next determined if the rotor stress controller 72 is governing the speed acceleration of the speed reference controller 36 in block 698. If this is the case, the RSC lamp 256 on panel 106 is lit and the signals 108, 110 and 112 are set in accordance with their derived values according to the instructions of block 700. If the rotor stress controller 72 is not governing the speed acceleration, then the RSC lamp 256 is cleared, the heat soak lamp 236 is cleared, the heat soak done flag is set, and the signals 108, 110 and 112 provided to the controller 36 are all open-circuited by the instructions contained in instructional block 702. After executing either instructional block 700 or 702, program execution is continued at the wait-for interrupt loop at 624.

While the preferred embodiment has been described in connection with a microprocesor-based controller and corresponding sequential pattern of instructions as exemplified by the flow charts of FIGS. 5A, 5B, 5C and 5D and including FIGS. 6A, 6B and 6C, it is understood that the functions as described in connection with FIGS. 2 and 3 shown hereinabove may alternately be implemented with analog hardware in a hard wired system without deviating from the broad principles of the present invention. Therefore, it is desired that the present invention be not limited to any one embodiment but rather construed in accordance with the breadth and broad scope of the claims to follow.

We claim:

1. In a turbine speed control system which is operative to control the speed of a steam turbine through a turbine start-up operation by regulating the position of at least one steam admission valve of said turbine in accordance with a speed control function based on a computed speed error between an adjustable speed reference signal and a signal representative of the actual speed of said turbine, said speed reference signal being adjusted, at times, to converge to a desired speed demand signal at a selected acceleration, an improvement comprising:

a first controller operative to control the speed of said turbine at selected accelerations from turning gear to a predetermined turbine speed value;

a second controller selectively operative to govern said turbine accelerations as controlled by said first controller in accordance with calculated present and anticipated rotor stresses of said steam turbine, said second controller performing said rotor stress calculations concurrently with the speed control operations of said first controller;

means for generating a plurality of signals representative of actual temperature differences of predetermined portions of said steam turbine and for providing said differential temperature representative signals to said first controller;

and wherein said first controller is further operative to reduce said turbine acceleration to substantially zero upon the detection of at least one of said representative temperature difference signals exceeding a preset limit value respectively associated therewith, said first controller being still further operative to detect when said turbine speed is controllably held substantially fixed in one of a number of predetermined critical speed zones as a result of said acceleration governing by said second controller or as a result of a temperature difference signal exceeding its preset limit value and to adjust said turbine speed outside of said one critical speed zone during either one of said detected turbine speed states.

2. A turbine speed control system in accordance with claim 1 wherein the second controller is additionally operative to govern the first controller to reduce the acceleration of the turbine to substantially zero for a predetermined time interval during the turbine start-up operation initiated by the occurrence of at least one of a plurality of conditions including a selective heat soak actuation and an event in which the turbine speed is controlled substantially to a predetermined heat soak speed value, said selective heat soak actuation being conditionally permitted when the speed reference signal is adjusted substantially equal to the desired speed demand signal by said first controller.

3. A turbine speed control system in accordance with claim 1 wherein the first controller is additionally operative to selectively override the reduction of the turbine acceleration to substnatially zero as caused by at least one representative temperature difference signal exceeding its preset limit value, said override when selected renders control of the turbine speed to proceed at the desired accelerations.

4. A turbine speed control system in accordance with claim 1 wherein the turbine comprises at least a high pressure turbine section and a lower pressure turbine section; and wherein the temperature differences are rendered between the following predetermined portions of the turbine;

(1) the first stage steam and first stage metal regions of the high pressure turbine section, (2) the horizontal flange and horizontal bolt regions of the high pressure turbine section, and (3) the horizontal flange and horizontal bolt regions of the lower pressure turbine section.

5. A turbine speed control system in accordance with claim 1 wherein the turbine comprises at least a high pressure turbine section; and wherein the temperature differences are rendered between the following predetermined portions of the high pressure tubrine section:

(1) the first stage steam and first stage metal regions, (2) the horizontal flange bolt and horizontal flange inner regions, and (3) the horizontal bolt and horizontal flange center regions.

6. A turbine speed control system in accordance with claim 1 wherein the first controller comprises:

a plurality of permanently programmable memory devices for storage of addressable ordered sets of selected instructions and data words;

a microprocessor bus;

means for coupling said plurality of permanently programmable memory devices to said microprocessor bus in accordance with an addressable pattern;

a system clock for generating a first periodic timing signal;

a real time clock for generating a second periodic timing signal;

a microprocessor coupled to said microprocessor bus and governed by said first periodic timing signal to process the instructions and data words of said plurality of permanently programmable memory devices, said processing enabling the first controller to control the speed of the turbine at desired turbine accelerations;

a speed monitoring means coupled to said microprocessor bus and operative in accordance with the processing of a first set of instructions by said microprocessor to periodically generate a speed signal representative of the actual speed of the turbine;

a temporary memory means, coupled to said microprocessor bus, for storage of temporary data words resulting from the instruction processing operations of the microprocessor; and an analog input means coupled to said microprocessor bus and operative in accordance with the processing of a second set of instructions by said microprocessor to digitize the temperature difference signals and to update the contents of corresponding registers in said temporary memory means with said digitized signals periodically as governed by said real time clock; wherein the second controller comprises:

a plurality of permanently programmable memory devices for storage of addressably ordered sets of selected instructions and data words;

a microprocessor bus;

means for coupling said plurality of permanently programmable memory devices to said microprocessor bus in accordance with an addressable pattern;

a system clock for generating a first periodic timing signal;

a real time clock for generating a second periodic timing signal;

a microprocessor coupled to said microprocessor bus and governed by said first periodic timing signal to process the instructions and data words of said plurality of permanently programmable memory devices, said processing including the computation of the present and anticipated rotor stress values and the generation of the governing accelerations therefrom;

a speed monitoring means coupled to said microprocessor bus and operative in accordance with the processing of a first set of instructions by said microprocessor to periodically generate a speed signal representative of the actual speed of the turbine;

a temporary memory means, coupled to said microprocessor bus, for storage of temporary data words resulting from the instruction processing operations of the microprocessor; and an analog input means coupled to said microprocessor bus and operative in accordance with the processing of a second set of instructions by said microprocessor to digitize a preselected number of turbine analog variables associted with said rotor stress calculations and to update corresponding registers in said temporary memory means with said digitized signals periodically as governed by said real time clock; and wherein each microprocessor-based first and second controller contains an interface to provide a data link for signal communication between the two controllers.

7. A turbine speed control system in accordance with claim 6 wherein the data link interface of each of the first and second microprocessor-based controllers comprises a didigal input/output means coupled to its corresponding microprocessor bus and operative in accordance with another set of instructions by its corresponding microprocessor to conduct digital information between the first and second microprocessor-based controllers.

8. A turbine speed control system in accordance with claim 6 wherein the second controller, upon being selectively actuated to govern the acceleration of the turbine as controlled by the first controller, generates a plurality of acceleration governing signals which are conducted between the second and first controllers over the data link interface.

9. A turbine speed control system in accordance with claim 8 wherein the plurality of acceleration governing signals includes a control signal indicating that the second controller has been selectively actuated to govern the turbine acceleration as controlled by the first controller, and a plurality of signals which when combined form a digital coded word that is representative of the desired accelertion value for turbine speed control.

* * * * *